US008870656B2

(12) United States Patent
Albrektsson et al.

(10) Patent No.: US 8,870,656 B2
(45) **Date of Patent: *Oct. 28, 2014**

(54) NAME-DAY GAMING

(75) Inventors: Bjorn Albrektsson, Lidingo (SE); Jorgen Michelsen, Saltsjo-Boo (SE); Bjorn Modee, Saltsjobaden (SE); Ian Vannman, Stockholm (SE)

(73) Assignee: NameO AB, Saltsjo-Boo (SE)

( * ) Notice: Subject to any disclaimer, the term of this patent is extended or adjusted under 35 U.S.C. 154(b) by 719 days.

This patent is subject to a terminal disclaimer.

(21) Appl. No.: 13/158,534

(22) Filed: Jun. 13, 2011

(65) Prior Publication Data

US 2012/0315990 A1 Dec. 13, 2012

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63F 3/06*** | (2006.01) |

(52) U.S. Cl.

CPC ..... *A63F 3/069* (2013.01)

USPC ..... 463/40; 434/204; 434/404; 463/1; 463/20; 463/25

(58) Field of Classification Search

CPC .... G06F 11/34; G06F 11/3495; A63F 3/0497

USPC ..... 434/204, 404; 463/1, 20, 25, 40

See application file for complete search history.

(56) References Cited

U.S. PATENT DOCUMENTS 6,712,616 B2 * 3/2004 Albrektson ..... 434/304

* cited by examiner

*Primary Examiner* — Adetokunbo O Torimiro

(74) *Attorney, Agent, or Firm* — Fasth Law Offices; Rolf Fasth

(57) ABSTRACT

The invention relates to a system (20), method, and a signal and a system for presenting a name of the day including a gaming opportunity. The gaming means comprises at least one of casino, lottery, sweepstakes, competition based gaming, and skill games being presented on said media channel means to be played by at least one of every person bearing the name of the day, and persons greeting a person bearing the name of the day through the media channel means (40).

6 Claims, 3 Drawing Sheets

10

| | |
|---|---|
| 12<br>MONDAY | NAME DAY OF THE CROWN PRINCESS<br><br>**VICTORIA** |
| 13<br>TUESDAY | **GREGER** |
| 14<br>WEDNESDAY | **MATILDA,<br>MAUD** |
| 15<br>THURSDAY | **KRISTOFFER,<br>CHRISTEL** |
| 16<br>FRIDAY | **HERBERT,<br>GILBERT** |
| 17<br>SATURDAY | **GERTRUD** |
| 18<br>SUNDAY | **EDVARD,<br>EDMUND** |

Fig. 1

(PRIOR ART)

NAME-DAY GAMING

REFERENCE

The following US Patent, U.S. Pat. No. 6,712,616 B2 to Björn Albrektsson is hereby incorporated by reference in the present invention. It is titled "SYSTEM FOR EDUCATION ABOUT NAMES".

TECHNICAL FIELD

The present invention pertains to a system for presenting a name of the day in connection with gaming, a method and a signal in a system therefore.

BACKGROUND ART

Most European countries present a given name of the day in their official almanacs. Mostly one name a day is presented, but there are also presentations of variants of a given name such as, for example, Marcus, Mark, and Marc could be presented on the same day. The name of the day is a joyful event mostly to the children, which are congratulated by their parents and other relatives on the very same day and often given a small gift.

When members of the Royal Family have their "name-day" it is an official flag-flying day in Sweden.

More generally a name-day is a Christian custom created with the purpose of undermining the heathen ancient birthday celebrations. Hence, a name list was created with its foundation on the day of the death of a saint, which day was given the name of the saint in question.

Nowadays more common names are listed in a name-day list, where the names are not necessarily connected to the names of saints. In order to spread the tradition of name-days and to educate people of the origin of their name, which famous people that bear the name etc., a need for a media system, more than an almanac, that can convey the tradition would be appreciated by many. Such a system would lead to a better step by step knowledge of our today and ancient history.

Moreover, there is a possibility for gaming on name days in accordance with the present invention.

The particulars of the present invention are set out in the attached independent claims, and further embodiments are set out in the attached dependent sub-claims.

SUMMARY OF THE DESCRIBED INVENTION

The present invention relates to educating individuals about our today and ancient history through the name-day concept. Moreover, the present invention provides a gaming opportunity to persons having a name of the day and/or people greeting persons having a name of the day by a media channel means.

In order to fulfill the aims and goals of the present invention it sets forth a system for presenting a name of the day including a gaming opportunity, comprising:

establishing means for establishing a name list of a predetermined period of days or on a day by day basis including at least one name of a human being for every day of the period;

a media channel means for broadcasting a name of a day media package comprising at least a presentation of the at least one name, wherein the media package and the at least one name correspond to the day of a broadcast;

presenting means for presenting the package on a display means, whereby an audience is educated about an origin of each name presented in the package; and gaming means providing a gaming opportunity through the media channel means for at least one of every person bearing the name of the day, persons greeting a person bearing the name of the day, and others interested in gaming on names through the media channel means.

One embodiment of the present invention provides the gaming means comprising at least one of casino, lottery, sweepstakes, competition based gaming, and skill games being presented on the media channel means to be played by at least one of every person bearing the name of the day, and persons greeting a person bearing the name of the day through the media channel means.

Another embodiment provides that the gaming means provide at least one of signs on reels, slot machines, tickets with scratch surface, roulette, and scratch cards, the gaming means connecting a name of the day to at least one of the name itself, a number related to the name, and an icon/sign related to the name.

Moreover, the present invention sets forth a method for presenting a name of the day including a gaming opportunity, comprising the steps of:

establishing a name list for a predetermined period of days or on a day by day basis including at least one name of a human being for every day of the period;

using a media channel for broadcasting a name of a day media package comprising at least a presentation of the at least one name, wherein the media package and the at least one name correspond to the day of a broadcast; and presenting the package on display means and educating an audience about an origin of each name presented in the media package; and providing a gaming opportunity through the at least one of a media channel means for at least one of every person bearing the name of the day, persons greeting a person bearing the name of the day, and others interested in gaming on names through the media channel means.

In one embodiment the gaming comprises at least one of casino, lottery, sweepstakes, competition based gaming, and skill games being presented on the media channel means to be played by at least one of every person bearing the name of the day, persons greeting a person bearing the name, and others interested in gaming on names of the day through the media channel means.

In a further embodiment the gaming provides at least one of signs on reels, slot machines, tickets with scratch surface, roulette, and scratch cards, the gaming means connecting a name of the day to at least one of the name itself, a number related to the name, and an icon/sign related to the name.

Furthermore, the present invention provides in combination, a signal and a system including a presentation means and a display means for presenting a name of the day media package including a gaming opportunity, the signal comprising:

At least one of a media channel signal means for broadcasting a name of a day media package comprising at least a presentation of at least one name of a human being, and a site providing gaming opportunities wherein the media package and the at least one name correspond to the day of a broadcast, wherein the signal controls the presentation means for the media package on the display means, whereby an audience is educated about an origin of each name presented in the package; and gaming means providing a gaming opportunity through the at least one media channel signal means for at least one of every person bearing the name of the day, persons greeting a person bearing the name of the day through the media channel means, and a site providing gaming opportunities.

An embodiment provides that the gaming means comprises at least one of casino, lottery, sweepstakes, competition based gaming, and skill games being presented by the media channel signal means to be played by at least one of every person bearing the name of the day, and persons greeting a person bearing the name of the day through the media channel signal means.

Further, one embodiment comprises the gaming means provide at least one of signs on reels, slot machines, tickets with scratch surface, roulette, and scratch cards, the gaming means connecting a name of the day to at least one of the name itself, a number related to the name, and an icon/sign related to the name.

BRIEF DESCRIPTION OF THE DRAWINGS

Henceforth reference is had to the attached figures throughout the description for a better understanding of the examples and embodiments of the present invention, whereby:

FIG. 1 is schematically illustrating a prior art calendar page, displaying names of the day for week No. II year 2001 according to the Swedish name list.

DETAILED DESCRIPTION OF PREFERRED EMBODIMENTS

The present invention relates to education of individuals about our today and ancient history through the name-day concept, which is prior art in regard of the US Patent, U.S. Pat. No. 6,712,616 B2 to Björn Albrektsson which is incorporated in the present invention by reference. By doing this the present invention introduces gaming in relation to a name of the day concept as an inventive concept.

As mentioned, more generally a name-day is a Christian custom created with the purpose of undermining the heathen ancient birthday celebrations. Hence, a name list was created with its foundation on the day of the death of a saint, which day was given the name of the saint in question.

Nowadays more common names among a population of people are listed in a name list, where the names are not necessarily connected to the names of saints. In order to spread the tradition of name-days and to educate people of the origin of their name, which famous people that bear the name etc., a need for a media system, more than an almanac, that can convey the tradition would be appreciated by many. Such a system would lead to a better step by step knowledge of our current and ancient history.

FIG. 1 is schematically illustrating a prior art calendar page 10, displaying names of the day for week No. 11 year 2001 according to the Swedish name list. Some days have only one name related to them, such as Monday 12, Tuesday 13, and Saturday 17, and other days have two names assigned, which often are closely related to each other. Week No. 11 of the Swedish calendar in accordance with FIG. 1, two names are assigned to Wednesday, Thursday, Friday, and Sunday. Only Thursday, for week No. 11, has two names assigned that immediately could be regarded as closely related, namely Kristoffer and Christel. Christel is a female given name.

The calendar of week No. 11 also comprises at least one day with a given name of a saint. Saturday is assigned Gertrud, named after St Gertrud. Week 11 is interesting in a lot of aspects and provides a given date for the Crown Princess Victoria of Sweden on Monday 12. This day is an official flag-flying day in Sweden. As many royalties are bearer of the name Victoria, it can be assumed that this day also can be an official flag-flying day in other Kingdoms.

Figure 2:
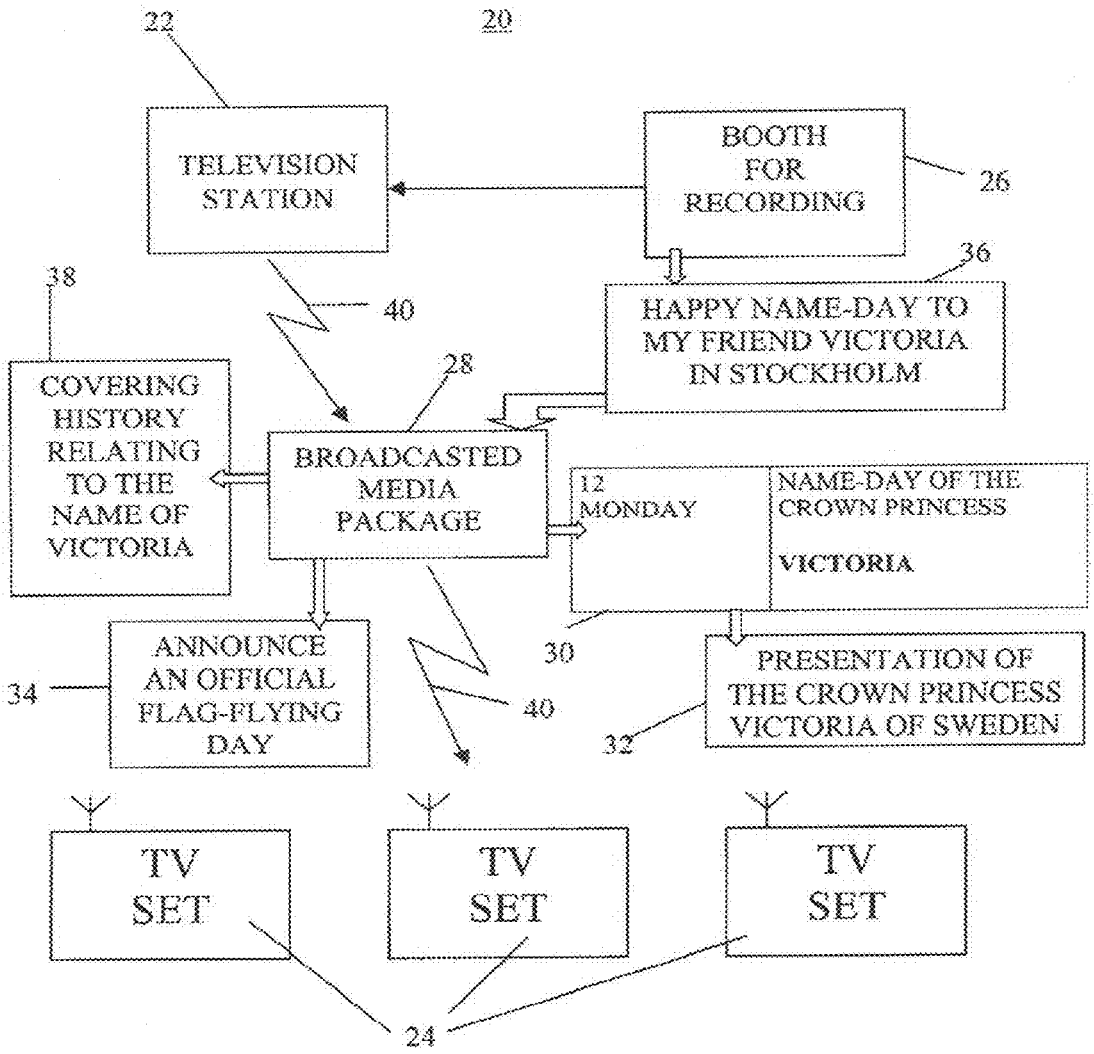
Fig 2 (PRIOR ART)
FIG. 2 schematically illustrates a prior art broadcasting system.

FIG. 2 schematically illustrates a prior art broadcasting system 20 utilized by present invention. It is assumed in this description as an example that the day for a broadcasting of a name-day package 28 is Mar. 12, 2001, a Monday, the name-day of Victoria. In a broad term, the embodiment of the broadcasting system 20 in accordance with FIG. 2 consists of a television station 22 for broadcasting of TV-programs, a room, booth 26 or the like where the public can record greetings to friends and relatives on their name-day. A broadcasting of TV programs is of course received by television sets 24, or the like apparatus for reception of a video signal or digital signal broadcast. It is appreciated that 30 the embodiment of FIG. 2 is one possible out of many. Examples of other systems 20 are radio, open networks such as Internet, Newspaper publisher, social networks, cellular networks such as 3G, 4G, their followers and other like multimedia. The receivers 24 are then, for example, radio receivers, PC computers, smartphones such like Iphone®, reading pads like Ipad®, desktop computers, and similar objects.

It is appreciated that the room, booth 26 or the like mentioned where the public can record greetings to friends and relatives on their name-day with current technology can be accomplished by for example, radio receivers, PC computers, laptop, smartphones such like Iphone®, reading pads like Ipad®, desktop computers, and similar objects.

As schematically depicted in FIG. 2 one embodiment comprises a media package 28, broadcasted to a public. The media package comprises a number of information/education to the public about the concept of name-day, in this embodiment occurring on Mar. 12, 2001, a Monday. Victoria is the name of the day which is comprised in the package 28 and indicated as 30 in FIG. 2. An announcer, newscaster or the like presents the name Victoria and announces the official flag-flying day 34, at least if the program or package 28 is broadcasted in the morning. The newscaster tells the origin of the name, how many bearers the name Victoria has, for example in the US, and in which state of the US most of them are citizens. Furthermore, an interview 32, old or new, is provided with a celebrity bearer 50 of the name Victoria, for example, the Crown Princess Victoria of Sweden.

Through the recording booth 26, ordinary people of the public are able to, for example, record a greeting to a dear friend 36 or relative, which is then transmitted to the television station 22, and broadcasted in the media program package 28.

In one embodiment, a newscaster or storyteller 38 shows trailers or vignettes of history related to the name Victoria. History could cover almost everything from births to wars, and the daily life in some ancient or close year. The media channel 40 for broadcasting of a package 28 is schematically drafted as flash arrows 40 in FIG. 2.

For countries that do not have an official name-day list, the US, this could be created by authorities, such as American Name Society (ANS), or under private supervision. Many different versions are possible, for example, different ethnic versions. It is also possible to choose a name every day in random through a random generator being provided given names from a suitable name database. As a matter of fact, the content of a media package 28 is only restricted by the imagination of a producer of the same.

The system 20 used for broadcasting of a media package 28 comprises establishing means for a name list of a predetermined period of days or on a day by day basis including at least one name for every day of the period. This establishing means could be a software program, being provided names from a name database. A media channel means for broadcasting a name of the day media package 28 comprising at least a presentation of the name(s) corresponding to the day of a broadcast 40 is provided. The system 20 of the present invention also comprises presenting means for the package 28 on a display means 24, whereby an audience is provided tangible education about a presented name or related history in the package 28. This presenting means can be software and/or software governed, with voice recordings, a videotape, sound tape, a CD, a DVD and other known devices for presentation of media. A number of media channels 40 and presenting means 24 could be used in different embodiments of the present invention.

Moreover, the present invention comprises a signal carrying a media package for presenting a name of the day. Thus it comprises:

a media channel signal means 40 for broadcasting a name of the day media package 28 comprising at least a presentation of the name(s) corresponding to the day of a broadcast;

and whereby the signal is controlling a presentation means for the package 28 on a display means 24, whereby an audience is educated about a presented name and its history in the package. Such a media signal could be an analogous or digital signal used for broadcasting in a suitable network such as television, radio, Internet etc.

Figure 3:
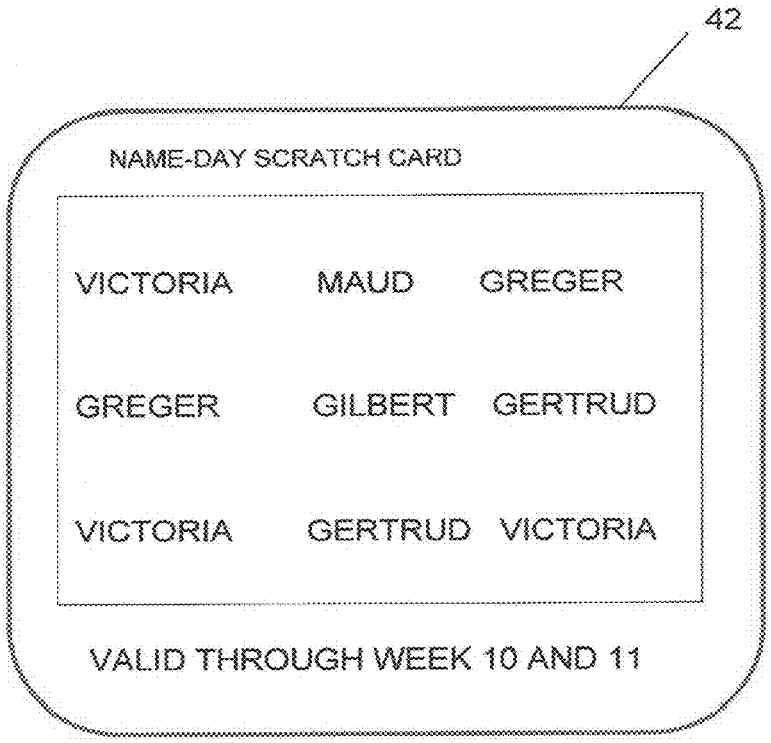
FIG. 3 schematically illustrates a scratch card with name-day names in accordance with the present invention.

FIG. 3 illustrates a scratch card 42 with name-day names in accordance with the present invention as one embodiment of the invention. The FIG. 3 scratch card 42 is in this embodiment valid during weeks 10 to 11, the year 2011 in the Swedish name day list, in which the names in the calendar page 10 occur in week 11, 2001. As can be seen in FIG. 3, the name Victoria appears three times, and indicates a win draw according to this example. Hence, those persons that bought the scratch card 42 mentioning Victoria three times has a prize to collect.

The scratch card according to the example in FIG. 3 is not intended to be limited to weeks #10 to 11, and to nine scratch names. It could cover an entire year or other time periods in other embodiments of the present invention.

One embodiment of the present invention provides the gaming means comprising at least one of casino, lottery, sweepstakes, competition based gaming, and skill games being presented on the media channel means to be played by at least one of every person bearing the name of the day, and persons greeting a person bearing the name of the day through the media channel means, and other persons logging on to the media channel.

Another embodiment provides that the gaming means provide at least one of signs on reels, slot machines, tickets with scratch surfaces, roulette, and scratch cards, the gaming means connecting a name of the day to at least one of the name itself, a number related to the name, and an icon/sign related to the name.

All the gaming means mentioned and the like could either be accessed on-line or provided at places/sites that provide gaming opportunities, such as casinos, game shops, and the like. Hence, in accordance with the present invention and its attached claims, the media channel with its media package 28 could be provided at the places/sites mentioned and broadcasted to those visiting the places/sites for gaming either through announcements digital or on paper, scratch cards, or digitally displayed on screens such as for instance flat screen TV devices or other television devices such as projection screens.

Moreover, regarding gaming machines as mentioned situated at places/sites for gaming, the machines themselves could display the media package 28 in one embodiment.

The aims and goals of the present invention provide a system for presenting a name of the day including a gaming opportunity. Hereby, it comprises establishing means for establishing a name list of a predetermined period of days or on a day by day basis including at least one name of a human being for every day of the period. A media channel means for broadcasting a name of a day media package comprising at least a presentation of the at least one name, wherein the media package and the at least one name correspond to the day of a broadcast. Furthermore, there exists presenting means for presenting the package on a display means, whereby an audience is educated about an origin of each name presented in the package.

In the system a gaming means provides an opportunity through the media channel means 40 for at least one of every person bearing the name of the day, and persons greeting a person bearing the name of the day, and others interested in gaming/betting on names through the media channel means.

Moreover the present invention comprises a method for gaming on names, and in combination, a signal and a system as described above.

The present invention is not restricted to examples and embodiments provided in this description. Other embodiments are possible for a person skilled in the art under consideration of the attached set of claims.

What is claimed is:

1. A system for presenting a name of a day including a gaming opportunity, comprising:

means for establishing a name list of a predetermined period of days or on a day by day basis including at least one name of a human being for every day of said period;

a media channel means for broadcasting a name of a day media package comprising at least a presentation of said at least one name, wherein the media package and the at least one name correspond to the day of a broadcast;

presenting means for presenting said package on a display means, whereby an audience is educated about an origin of each name presented in said package;

a gaming means providing gaming opportunity through said media channel means for at least one of every person bearing the name of said day, persons greeting a person bearing said name of the day, and others interested in gaming on names through said media channel means; and said gaming means comprises at least one of casino, lottery, sweepstakes, competition based gaming, and skill games being presented on said media channel means to be played by at least one of every person bearing the name of the day, persons greeting a person bearing said name of the day, and others interested in gaming on names through said media channel means.

2. The system according to claim 1, wherein said gaming means provide at least one of signs on reels, slot machines, tickets with scratch surface, roulette, and scratch cards, said gaming means connecting a name of the day to at least one of the name itself, a number related to the name, and an icon/sign related to the name.

3. A method for presenting a name of a day including a gaming opportunity, comprising the steps of:

a broadcasting system establishing a name list for a predetermined period of days or on a day by day basis including at least one name of a human being for every day of said period;

the broadcasting system using a media channel for broadcasting a name of a day media package comprising at least a presentation of said at least one name, wherein the media package and the at least one name correspond to the day of a broadcast;

the broadcasting system presenting said package on display means and educating an audience about an origin of each name presented in said media package;

the broadcasting system providing a gaming opportunity through said media channel means for at least one of every person bearing the name of said day, persons greeting a person bearing said name of the day, and others interested in gaming on names through said media channel means; and said gaming comprises at least on casino, lottery, sweepstakes, competition based gaming, and skill games being presented on said media channel means to be played by at least one of every person bearing the name of said day, and persons greeting a person bearing said name of the day through said media channel means.

4. The method according to claim 3, wherein said gaming provides at least one of signs on reels, slot machines, tickets with scratch surface, roulette, and scratch cards, said gaming means connecting a name of the day to at least one of the name itself, a number related to the name, and an icon/sign related to the name.

5. In combination, a signal and a system including a presentation means and a display means for presenting a name of a day media package including a gaming opportunity, said signal comprising:

a media channel signal means for broadcasting a name of a day media package comprising at least a presentation of at least one name of a human being, wherein the media package and the at least one name correspond to the day of a broadcast, wherein said signal controls said presentation means for said media package on said display means, whereby an audience is educated about an origin of each name presented in said package; and a gaming means providing gaming opportunity through said media channel signal means for at least one of every person bearing the name of said day, persons greeting a person bearing said name of the day, and others interested in gaming on names through said media channel means; and said gaming comprises at least one of the casino, lottery, sweepstakes, competition based gaming, and skill games being presented by said media channel signal means to be played by at least one of every person bearing the name of said day, and persons greeting a person bearing said name of the day through said media channel signal means.

6. The signal and the system according to claim 5, wherein said gaming means provide at least one of signs on reels, slot machines, tickets with scratch surface, roulette, and scratch cards, said gaming means connecting a name of the day to at least one of the name itself, a number related to the name, and an icon/sign related to the name.

* * * * *